United States Patent [19]

Richey

[11] 4,105,262

[45] Aug. 8, 1978

[54] RELEASABLE DRILL STRING STABILIZER

[76] Inventor: Vernon T. Richey, 3061 Los Palmas, Houston, Tex. 77027

[21] Appl. No.: 789,969

[22] Filed: Apr. 22, 1977

[51] Int. Cl.[2] ..... F16C 1/26; E21B 17/10

[52] U.S. Cl. ..... 308/4 A; 166/241; 403/369; 403/370; 403/374

[58] Field of Search ..... 308/4 R, 4 A, 8.2; 166/241; 175/76, 325, 408; 24/263 D, 263 DB; 403/369, 370, 371, 374, 314

[56] References Cited

U.S. PATENT DOCUMENTS

| | | | |
|---|---|---|---|
| 2,824,613 | 2/1958 | Baker et al. | 166/241 |
| 2,973,996 | 3/1961 | Self | 308/4 A |
| 3,916,998 | 11/1975 | Bass et al. | 308/4 A |
| 4,000,549 | 1/1977 | Brumley et al. | 308/4 A |

*Primary Examiner*—Trygve M. Blix
*Assistant Examiner*—Charles E. Frankfort

[57] ABSTRACT

A releasable stabilizer is provided for adjustable positioning along a drill string. The stabilizer includes a body positioned around the drill string with a threaded section on each end; a clamping wedge used at each end with an inwardly facing surface to grip the drill string; and a threaded end cap for forcing the wedge against the drill string by screwing the end cap onto the body to clamp the assembly onto the drill string.

6 Claims, 3 Drawing Figures

RELEASABLE DRILL STRING STABILIZER

BACKGROUND AND SUMMARY OF THE INVENTION

It is well known that stabilizers are used in well drilling to aid in drilling direction holes, to aid in drilling a straight hole and to prevent contact between the drill string and the bore hole. In the past, the stabilizers were made up within the drill string as the string was run into the hole; however, this arrangement has several undesirable aspects because it adds tool joint connections to the drill string, which increases possible points of failure in the drill string, causes variations in drill collar stands which increases trip time and unsafe operation for rig personnel, requires a special bottom hole assembly which increases drilling costs, and does not permit adjustment of the stabilizer along the drill string without changing stubs which increases drilling costs.

The use of lock-on stabilizers has been suggested to solve these undesirable aspects. Typically, the lock-on stabilizer has a body with externally extending blades, two end caps for connecting to the body, an inside solid locking ring and two outside solid locking rings with a single tapered surface for each ring. The stabilizer is connected between pin and box joints on the drill string by positioning the inside locking ring inside the body, positioning an outside locking ring on either end of and with the tapered surface facing the inside locking ring. Two end caps are used to force the rings together within the body to connect the stabilizer to the drill string. A major difficulty with this arrangement has been its inability to be reused after once being attached. This difficulty is caused by the inherent inability of the solid locking rings to clamp around the drill string without being deformed.

It is also well known that the externally extending blades wear rapidly and break when drilling through abrasive earth formations and when contacting casing. This breakage can prevent the drilling mud from passing on the return trip to the surface, which forces a replacement of the stabilizer. This replacement of course takes time and is expensive.

It is, therefore, an object of this invention to provide a stabilizer that is rapidly and easily releasably connected to a drill string for adjustable positioning along the drill string.

It is a further object of this invention to provide a drill string stabilizer with easily replaceable externally extending blades.

Moreover, an object of the present invention is to provide a stabilizer of simple and inexpensive construction which is releasably connected to a drill string.

In accordance with the invention, a releasable stabilizer is provided for adjustable positioning along a drill string. The stabilizer has a body for positioning around the drill string having female threads at each end of the body on the interior surface, a tapered portion of the interior surface extending outwardly to the female threads and blades extending from the exterior surface of the body to contact the bore hole. An end cap is provided for each end of the body and has male threads at one end of the exterior surface and a tapered portion of the interior surface extending outwardly toward the end with the male threads. At least one clamping wedge is used for each of the body and has a surface formed by first and second tapered portions, the first tapered portion tapering in a direction opposite to the taper of the second tapered portion. Each clamping wedge also has a gripping surface for moving into contact with and gripping the drill string by positioning the surface of the first tapered portion of said clamping wedge against the interior surface tapered portion of said body and threadably connecting said end cap to said body, which causes the interior surface tapered portion of said end cap to move against the surface of the second tapered portion of said clamping wedge for ultimately attaching the stabilizer onto the drill string.

BRIEF DESCRIPTION OF THE DRAWINGS

Other objects and advantages of the invention will become apparent upon reading the following detailed description of the invention and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
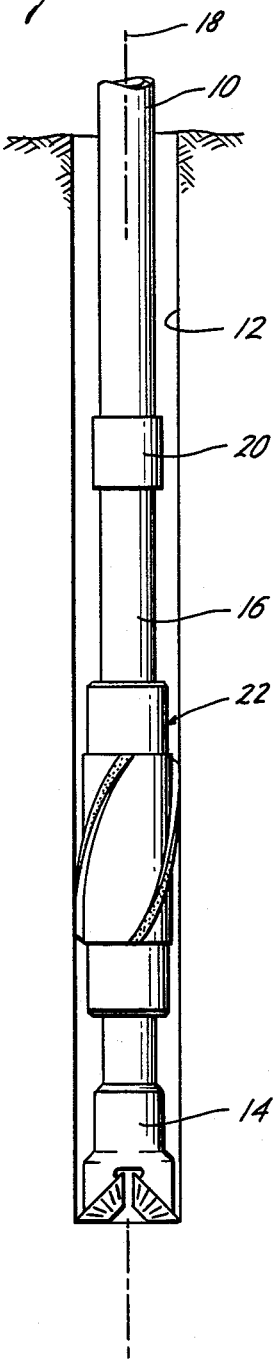
FIG. 1 is an elevational view, partly in section, showing a stabilizer of the present invention installed on a drill string in a well.

As best seen in FIG. 1, a drill string 10 is located within a bore hole 12 made by drill bit 14. When desired a drill collar 16 is made up in drill string 10 over drill bit 14. Drill string 10 is of conventional design extending from the earth's surface to rotate drill bit 14 having an axis 18 and the component parts being attached by conventional joints 20, such as by pin and box joints. Although a single stabilizer 22 is illustrated as being attached to drill string 10 at drill collar 16, it is to be understood that single or multiple stabilizers 22 may be attached to drill string 10 at any elevation.

Figure 2:
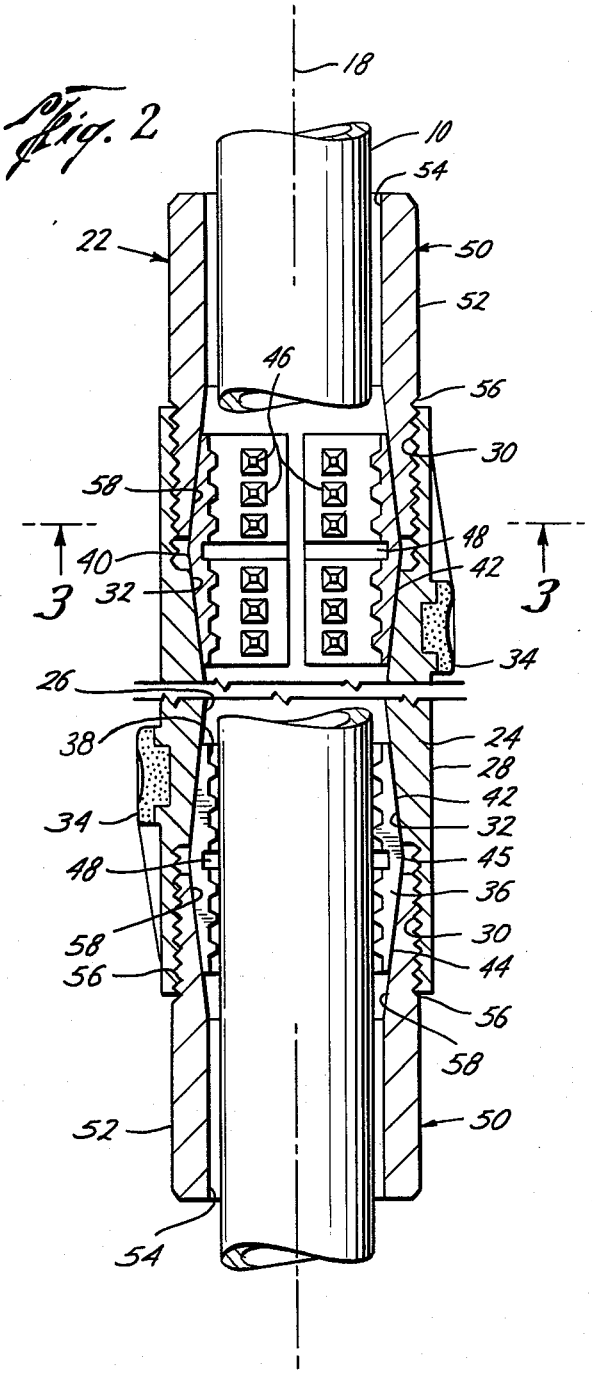
FIG. 2 is an enlarged elevational view, partly in section, illustrating the detailed construction of the invention shown in FIG. 1.

As best seen in FIG. 2, stabilizer 22 is constructed from a tubular body 24, positioned around drill collar 16 with an axis lying substantially coincident with drill string axis 18. Body 24 has an interior surface 26 facing toward drill string 10 and an exterior surface 28 facing away from drill string 10. A threaded surface 30 is located at each end of body 24 and is interiorly facing to form male threads and preferably displaced outwardly from interior surface 26. An interiorly facing tapered surface 32 extends outwardly from interior surface 26 to outwardly displaced threaded surface 30. Although interior surface 26 is shown as tapered in FIG. 2, such surface does not have to be tapered and should lie substantially parallel around drill string 10. Blades 34 extend outwardly from exterior surface 28 to contact bore hole 12. Blades 34 are of conventional design, but when used in a bottom hole assembly the helical shape is preferred. Although body 24 and blades 34 may be constructed as a unit, it is preferred that tungsten carbide inserts be used for improved wear resistance. The inserts are attached to body 24 by using a tongue and groove connection to permit easy replacement.

Figure 3:
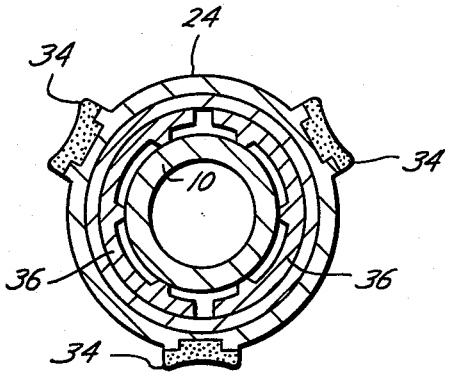
FIG. 3 is a plan view taken in the direction of arrows 3—3 of FIG. 2.

At least one clamping wedge 36 is provided for each end of body 24. Preferably, two or more wedges are used at each end of body 24, as shown in FIG. 3, so that a more uniform inwardly gripping force is obtained. Each wedge 36 has a gripping surface 38 for contacting and gripping the exterior of drill string 10 and an outwardly facing surface 40. Outwardly facing surface 40 is formed from a first tapered portion 42 and a second tapered portion 44. First tapered portion 42 is constructed to taper in a direction opposite to the direction of taper of second tapered portion 44. It is preferred that each wedge 36 is symmetrical on either side of a junction 45 between first tapered portion 42 and second tapered portion 44 to form a V-shape when viewed in a cross section taken radially of drill string 10. Further, a multiplicity of gripping teeth 46 are disposed on inwardly facing surface 38 to provide an improved grip on drill string 10. The shape of teeth 46 are pyramid-like with the apex truncated to inhibit damage to drill string 10. Also, a groove 48 is preferably disposed in inwardly facing surface 38 centrally located beneath the junction formed between first tapered portion 42 and second tapered portion 44 extending circumferentially around drill string 10 to permit a crimping action against drill string 10 when being attached.

An end cap 50 is provided for each end of body 24 for positioning around drill string 10 and connecting to body 24. Each end cap 50 has an exterior surface 52 facing outwardly from drill string 10 and an interior surface 54 facing inwardly toward drill string 10. A threaded surface 56 is provided to form male threads for engaging female threads 30 of body 24. Also, an interiorly facing tapered portion 58 is provided to extend outwardly from interior surface 54 toward the end with male threads 56.

In operation, drill string 10 is made up and run into bore hole 12 for drilling. At each desired location, a stabilizer 22 is added to drill string 10 by disposing body 24 and end caps 50 around drill string 10. At least one clamping wedge 36 is then positioned around string 10 and at each end of body 24 with first tapered portion 42 abutting interior surface tapered portion 32 of body 24. Male threads 56 of each end cap 50 is screwed into female threads 30 of body 24, which causes end caps 50 to move longitudinally of axis 18 and interior surface tapered portion 58 for complementary matching with second tapered portion 44 of body 24. This longitudinal movement of end caps 50 and cooperative action between tapered portions 42 and 32 and tapered portions 44 and 58 causes each wedge 36 to move inwardly toward and engage drill string 10. Stabilizer 22, thus, becomes releasably connected to drill string 10 by threadably connecting end caps 50 to body 24.

Thus, it is apparent that there has been provided, in accordance with the invention, a drill string stabilizer that fully satisfies the objects, aims and advantages set forth above. While the invention has been described in in conjunction with a specific embodiment thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

What is claimed is:

1. A releasable stabilizer for adjustable positioning along a drill string, comprising:

(a) a body for positioning around the drill string having
  (i) female threads at each end of the body on the interior surface,
  (ii) a tapered portion of the interior surface extending outwardly to the female threads,
  (iii) blades extending from the exterior surface of the body to contact the bore hole;

(b) an end cap for each end of said body having
  (i) male threads at one end on the exterior surface,
  (ii) a tapered portion of the interior surface extending outwardly toward the end with the male threads; and (c) at least one clamping wedge for each end of said body having
  (i) a surface formed by first and second tapered portions, the first tapered portion tapering in a direction opposite to the taper of the second tapered portion,
  (ii) a gripping surface for moving into contact with and gripping the drill string by positioning the surface of the first tapered portion of said clamping wedge against the interior surface tapered portion of said body and threadably connecting said end cap to said body, which causes the interior surface tapered portion of said end cap to move against the surface of the second tapered portion of said clamping wedge for ultimately attaching the stabilizer onto the drill string.

2. The stabilizer of claim 1, wherein each said wedge is symmetrical on either side of a junction between the first tapered portion and the second tapered portion to form a V-shape when viewed in a cross-section taken radially of the drill string axis.

3. The stabilizer of claim 2, wherein each wedge has a groove disposed in the gripping surface centrally located beneath the junction between the first tapered portion and the second tapered portion extending circumferentially around the drill string for crimping said wedge onto the drill string when connecting the end cap to the body.

4. The stabilizer of claim 1, wherein two or more wedges are used at each end of said body.

5. The stabilizer of claim 1, wherein each clamping wedge includes pyramid shaped teeth with the apex truncated to form the gripping surface extending internally to prevent movement of the stabilizer relative to the drill string.

6. The stabilizer of claim 1, wherein the blades on said body are adapted for easy replacement through a tongue and groove type connection.

* * * * *